United States Patent [19]

Grossman et al.

[11] 4,040,560

[45] Aug. 9, 1977

[54] CARTON ADAPTED TO BE STACKED FLAT AND SNAPPED OPEN

[76] Inventors: Milton J. Grossman, 10296 S. Mina, Whittier, Calif. 90605; Deanna Rose Lewis, 2061 Wallace No. B, Costa Mesa, Calif. 92627

[21] Appl. No.: 740,124

[22] Filed: Nov. 8, 1976

[51] Int. Cl.[2] ..... B65D 5/36

[52] U.S. Cl. ..... 229/41 B; 229/39 R

[58] Field of Search ..... 229/41 R, 41 B, 39 R

[56] References Cited

U.S. PATENT DOCUMENTS

| | | | |
|---|---|---|---|
| 797,446 | 8/1905 | Medley | 229/41 B X |
| 805,234 | 11/1905 | Rutledge | 229/41 B UX |
| 1,375,489 | 4/1921 | Davis | 229/41 B X |
| 2,884,180 | 4/1959 | Inman | 229/41 B |
| 2,934,254 | 4/1960 | Ullger | 229/41 B |
| 3,003,678 | 10/1961 | Chase | 229/41 B X |
| 3,960,313 | 6/1976 | Sax et al. | 229/41 B |

FOREIGN PATENT DOCUMENTS

| | | | |
|---|---|---|---|
| 103,931 | 3/1966 | Denmark | 229/41 B |

*Primary Examiner*—Davis T. Moorhead

*Attorney, Agent, or Firm*—J. C. Baisch

[57] ABSTRACT

An instantaneous, snap-open, four-sided carton adapted to be stacked flat and snapped open. The carton is formed from a blank of cardboard and scored to define a plurality of parallel panels forming the vertical or longitudinal sides of the carton. There are two oppositely arranged flaps which form the bottom of the carton when it is open. These bottom flaps are diagonally scored to form fold lines or troughs and one of the flaps is diagonally longer than the other. When the carton is folded flat, the respective scored flaps are folded along the scored lines so that the parts of the respective flaps at opposite sides of the score lines are folded together or onto themselves. As the opposite free corners of the flattened carton are pressed toward each other, the scored flaps open up, first forming V-shaped troughs. The trough of the shorter flap enters the trough of the longer trough and is guided inwardly by the longer trough until the carton is fully open. With the carton fully open, the scored flaps are normal to the sides of the carton and are held by stops against bulging outward or downward under the weight of the contents of the carton.

13 Claims, 18 Drawing Figures

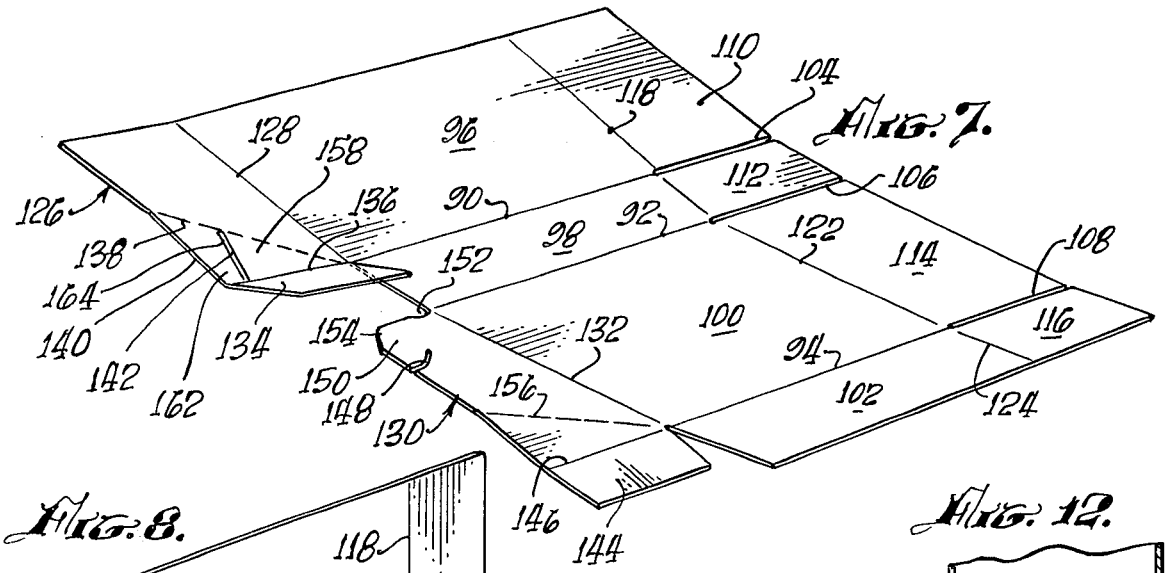
Fig. 7.
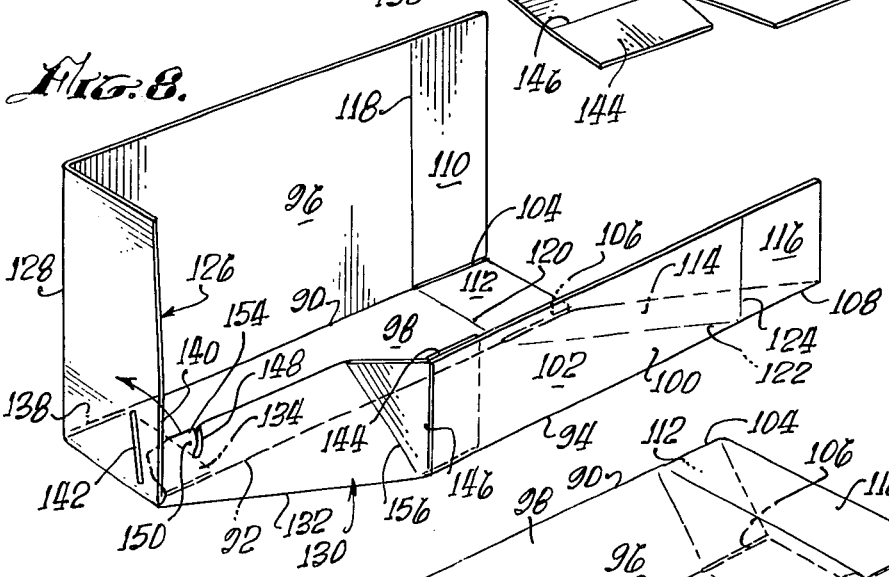
Fig. 8.
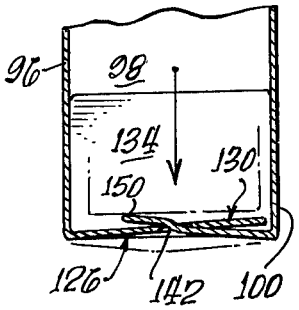
Fig. 12.
Fig. 9.
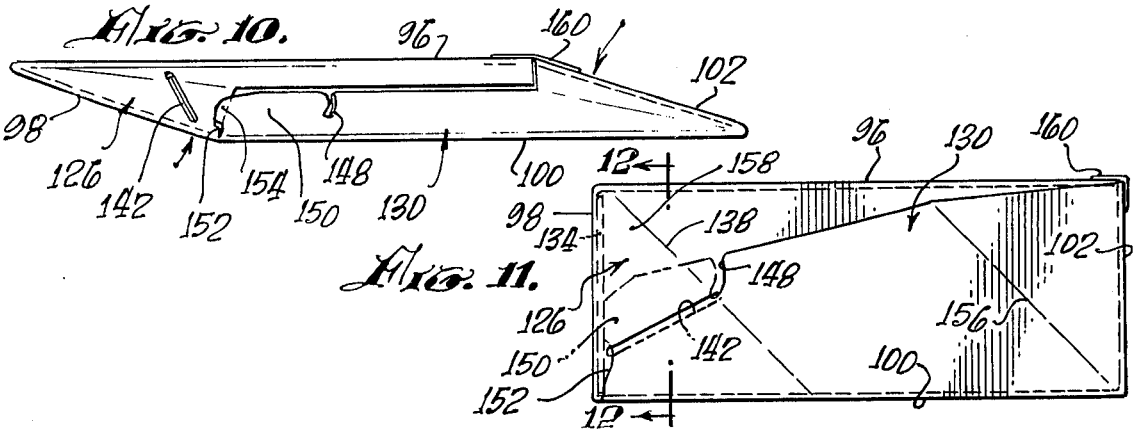
Fig. 10.
Fig. 11.

CARTON ADAPTED TO BE STACKED FLAT AND SNAPPED OPEN

BACKGROUND OF THE INVENTION

1. Field of the Invention

This invention relates generally to cartons and relates more particularly to instantaneous, snap-open cartons adapted to be stacked flat and snapped open with parts automatically positioned to form the bottom of the carton when opened.

2. Description of the Prior Art

Various types of cartons have been proposed but the flaps forming the bottom are, as far as we are aware, complicated and not satisfactory. Some must be individually and manually unfolded and individually connected together by hand.

SUMMARY OF THE INVENTION

An instantaneous, snap-open, four-sided carton adapted to be stacked flat and snapped open. The carton is formed from a blank of cardboard or other suitable material and scored to define a plurality of parallel panels forming the vertical sides of the carton. There is a flap for each panel for the bottom end of the carton, one flap being an extension of an end panel of the blank thus being an end flap and another flap being an extension of an intermediate panel spaced apart from the end flap by the width of a panel thus being an intermediate flap. In one embodiment, the end flap is provided with a tongue on the free edge thereof and the intermediate flap is provided with a generally diagonal slot for reception of the tongue when the carton is opened. The end flap is diagonally scored from the junction of its end panel and the adjacent panel, and the tongue is formed by side notches, the inner ends of which form stops when the tongue is fully received in the slot. The intermediate flap is also scored with the scoring intersecting the slot. There are additional flaps connected to the end and intermediate flaps for attachment to the inner surfaces of adjacent panels which form the sides of the carton. The free edges of the end panels are connected together by an adhesive tape or the like or by any other suitable means. When the end panels are secured together, the carton is folded flat, the end flap and intermediate flap are folded along their score or fold lines to form V-shaped troughs or channels. When the free edges of the flattened carton are pressed together, that is toward each other, the tongue of the end panel, slides in the trough or channel of the intermediate flap and is automatically guided into the slot. When the tongue is fully received in the slot, edges of the slot engage shoulders at the base of the tongue to prevent the bottom flaps from bulging outward or downward from the weight of the contents of the carton.

In another embodiment of the invention, one of the flaps forming the bottom of the carton, is diagonally longer than the other bottom flap and is of the same dimensions as the cross-section of the carton when open. Two sides of the longer bottom flaps are connected to side flaps, termed anchoring flaps, adhesively secured to their respective, adjacent panels while the other, or free edges of the longer flap, lie along the folds of the shorter bottom flap. Thus, the larger flap completely closes the bottom of the carton when open and is fully supported about its periphery so that the contents of the carton is fully supported. Additional support for the larger flap is provided by the smaller flap when the carton is in its open position.

OBJECTS AND ADVANTAGES OF THE INVENTION

It is an object of the invention to provide a carton that may be blanked and formed from a sheet of material and folded flat for stacking, storage, packaging and/or shipping.

It is another object of the invention to provide a carton of this character wherein there are bottom parts for forming the bottom, which will easily, quickly and automatically go into place when opposite edges of the folded carton are pressed together to unfold and open the carton.

It is still another object of the invention to provide cartons of this character wherein the parts for forming the bottom are so positioned, when the carton is opened, as to hold said bottom parts against bulging outwardly under the weight of the contents of the carton.

It is a further object of the invention to provide cartons of this character that is simple in construction.

It is a still further object of the invention to provide a carton of this character that is relatively inexpensive to manufacture.

Another object of the invention is to provide a carton of this character that saves time in opening the carton preparitory to filling same.

The characteristics and advantages of the invention are further sufficiently referred to in connection with the following detailed description of the accompanying drawings which represent certain embodiments. After considering these examples, skilled persons will understand that many variations may be made without departing from the principles disclosed and I contemplate the employment of any structures, arrangements or modes of operation that are properly within the scope of the appended claims.

BRIEF DESCRIPTION OF THE DRAWINGS

Referring to the drawings which are for illustrative purposes only:

FIG. 7 is a perspective view of a blank of an alternative arrangement;

FIG. 8 is a perspective view of the blank that has been partly folded;

FIG. 9 is a perspective view of the blank further folded;

FIG. 10 is a bottom view of the carton in almost the fully flattened position;

FIG. 11 is a bottom end view of the carton in its fully opened position;

FIG. 12 is a sectional view taken on line 12—12 of FIG. 11;

DESCRIPTION OF THE PREFERRED EMBODIMENTS

Figure 1:
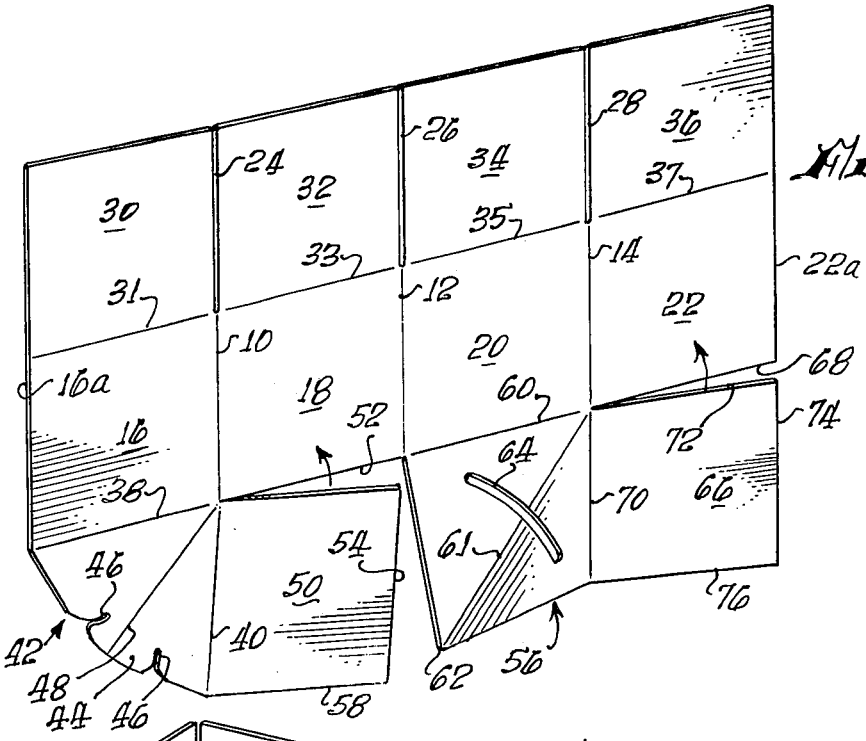
FIG. 1 is a perspective view of a blank for one embodiment of the invention.

Referring to FIGS. 1 to 6, there is shown one embodiment of the invention. The carton of this embodiment is formed from a blank of suitable material such as, for example, heavy paper, cardboard, corrugated paper, or any other suitable material. The blank is scored along lines 10, 12, and 14 to provide a plurality of panels 16, 18, 20 and 22. The score lines are parallel and laterally spaced apart and the panels defined by said score lines are parallel and form the sides of the carton. The blank is also cut along lines 24, 26 and 28 to provide cover flaps 30, 32, 34 and 36 for the upper end of the carton. The cuttings of the blank are along continuations of the scored lines 10, 12 and 14. There are also score lines 31, 33, 35 and 37 which constitute fold lines for the cover flaps for folding same to the closed position.

The bottom of the panel 16 is scored by a horizontal line 38 which may also be considered a fold line. There is also a score or fold line 40 which is a continuation of the score line 10. From the score or fold line 38 there extends a first flap indicated generally at 42 which has a portion of the outer free edge removed, and from the outer free edge of flap 42 there is a tongue 44 between notches 46, said tongue also being scored by a score line 48 extending from the lower end of the score line 10, diagonally and centrally through the tongue. A flap 50, termed a second flap, has one edge connected to the flap 42 along the score line 40, said second flap is of the same width as panel 18 and is severed from the bottom edge 52 of panel 18. The side 54 of the second flap is severed from the adjacent flap 56 and said side 54 is free as is the outer edge 58 of said second flap.

Flap 56, or third flap, is a continuation of panel 20 and is connected thereto along a score or score line 60. This flap is scored along line 61 which extends from the lower end of score line 14 to the diagonally opposite corner 62 of flap 56. This flap is provided with a slot 64 shown as being arcuate and which is intersected midway by the score line 61. Slot 64 is substantially normal to the score line 61 and while the slot is shown as being arcuate, it may also be straight.

There is a fourth flap indicated at 66 which is severed from panel 22, the lower end of panel 22 being indicated at 68. Flap 66 is connected to flap 56 along a score line 70 which is a continuation of score line 14. Flap 66 thus has free edges 72, 74 and 76.

It is to be noted that the container of embodiment of FIGS. 1 to 6 is square in cross-section so that panels 16, 18, 20 and 22 are of equal width.

Figure 2:
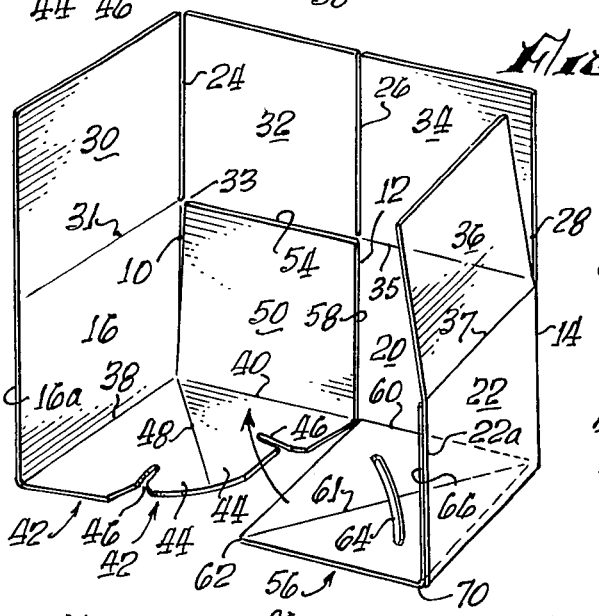
FIG. 2 is a perspective view of the blank partly folded.

In FIG. 2, the blank is shown as partly folded, the end panels 16 and 22 being folded along score lines 10 and 14 so that said panels are normal to panels 18 and 22 respectively. Also, flaps 42 and 56 have been folded inwardly normal to panels 16 and 20 and flaps 50 and 66 have been folded upwardly and secured by an epoxy cement of by any other suitable adhesive, to the inner surfaces of panels 18 and 22.

Figure 3:
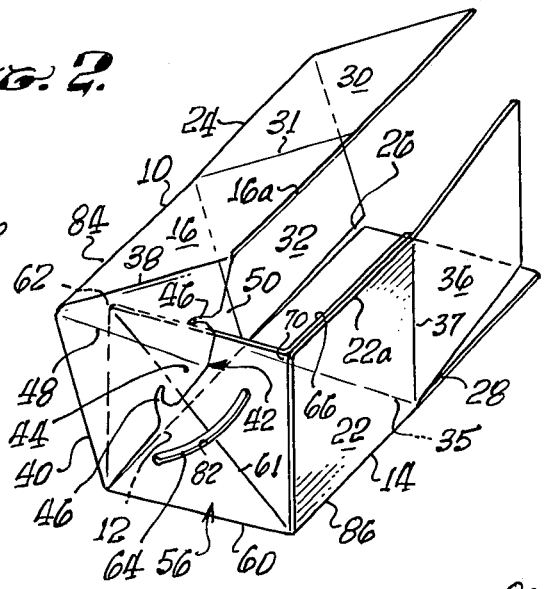
FIG. 3 is a perspective view of the blank additionally folded.

In FIG. 3, the blank is shown as additionally folded with the free edges 16*a* and 22*a* spaced from but adjacent to each other. Flaps 42 and 56 are substantially normal to the panels.

Figure 5:
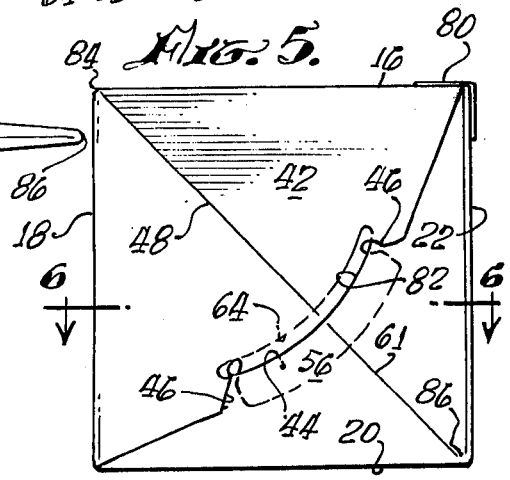
FIG. 5 is an end view of the bottom of the carton when in its open position.
Figure 6:
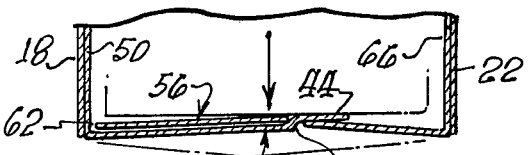
FIG. 6 is a sectional view taken on line 6—6 of FIG. 5.

In FIG. 5, the edges 16*a* and 22*a* have been brought together. A strip of adhesive tape 80 secures the panels 16 and 22 together. Tongue 44 is disposed in slot 64 and the outer edge 82 of slot 64 is in engagement or abutment with the bottoms of notches 46 thereby preventing the flaps 42 and 56 from yielding downwardly or outwardly from the weight of the contents of the carton when filled.

Figure 4:
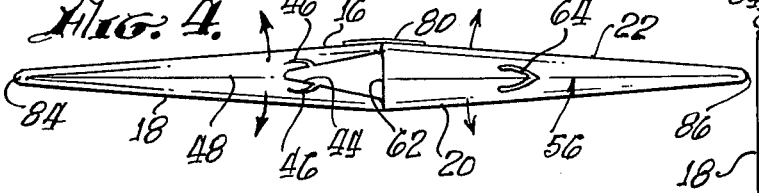
FIG. 4 is an end view of the fully folded carton in its collapsed or flat position.

Referring to FIG. 4, the formed carton is folded flat along carton edges 84 and 86. When thus flattened, flap 42 is folded inwardly on itself along the score line 48. Thus, a trough or valley is formed which includes the tongue 44.

Flap 56 is also folded in inwardly along its score line 61 to form a trough or valley. Flap 56 is longer diagonally along the score line 61 than flap 42 along its score line 48 and when the carton is folded flat, that part of the flap 56 between the slot 64 and free corner 62, extends beyond the free end of the tongue 44 so that when the corners 84 and 86 of the flattened carton are pressed toward each other, the tongue 44 will enter the trough or valley of flap 56 and be guided into the slot, as best shown in FIG. 5, thus automatically forming a secure bottom for the carton. As pointed out above, this bottom will not give-way or bulge outwardly from the weight of the contents of the carton.

EMBODIMENTS OF FIGS. 7 THROUGH 12

Referring to FIGS. 7 through 12, there is shown an alternative arrangement wherein the carton is rectangular in cross-section. In FIG. 7 there is shown a blank of suitable material which is scored longitudinally relative to the finished carton, the score lines being indicated at 90, 92 and 94 to define panels 96, 98, 100 and 102.

The blank is cut in alignment with the score lines as indicated at 104, 106 and 108 to provide flaps 110, 112, 114 and 116. There are also score lines 118, 120, 122 and 124 to provide for accurate folding of flaps 110, 112, 114 and 116. These flaps are adapted to close the upper end of the carton.

At the opposite end of the blank are the parts adapted to form the bottom of the carton when the carton is fully formed and open. These parts are a flap 126 connected to the panel 96 by a score line 128 and a flap 130 which is connected to panel 100 by a score line 132. Flap 126 is of the same length as the width of panel 96, and flap 130 is of the same length as the width of panel 100. At the inner end of flap 126 there is a flap 134 which extends from a score line 136 at the inner end of flap 126, the score line 136 being a continuation of score line 90 and in alignment therewith. It is to be noted that flap 134 is of the same length as the width of the narrow panel 98. Except for the end of flap 134, connected to the flap 126, the edges of flap 134 are free. Flap 126 is adapted to be folded along the dashed or fold line 138 which extends from the junction of score lines 90 and 136 to a point intermediate the ends of the free longitudinal edge 140 of flap 126. A slot 142 is provided in flap 126 between the score line 136 and the fold line 138, said slot being inclined at an obtuse angle relative to the fold line 138. The angle of the slot is such, that the end at the score line 136 is closer to the free edge 140 of the flap 126, than the end terminating at the dashed fold line 138.

Flap 130 is in line with panel 100 and is connected thereto along the score line 132. At the outer end of flap 130, there is a flap 144 which is connected to the flap 130 along score line 146 which is a continuation or extension of score line 94, flap 144 being of the same length as the width of panel 102, having been severed from panel 102. At its inner end, flap 130 is provided with an arcuate notch 148 extending from the longitudinal free edge of flap 130 to thereby define a part of a tongue 150. An opposite part of tongue 150 is defined by a notch 152 and the outer end 154 of said tongue is pointed. Flap 130 is adapted to be folded along the dashed or fold line 156.

In FIG. 8, the blank is shown as partly folded with panels 96 and 102 vertical. Flap 126 is also vertical and normal to panel 96. Flap 134 lies on the inner side of panel 98 and is secured thereto by a suitable adhesive, such as, for example, an epoxy cement. The part 158 of flap 126 at the slotted side of the fold line 138 is positioned so that the tongue 154 will enter the slot when the blank is further folded as shown in FIG. 9. In FIG. 8, the flap 130 is folded along the fold line 156 and the flap 144 is secured to the inner side of panel 102 and at the adjacent end thereof.

FIG. 9 shows the panels 96 and 102 as secured together by an adhesive strip 160. The carton is partly flattened, as shown in FIG. 9, and the flap 126 being partly folded along fold line 138 to provide a valley and flap 130 is partly folded along fold line 156. When the carton is thus partly folded, the tongue 150 rides on the adjacent part 152 of the flap 126 and slides into the slot 142 as the carton is fully formed, as shown in FIG. 12. When the carton is fully formed, the bottom flaps interlock, with what is termed herein, the outer edge 164 of the slot 142 in abutement with the bottom notch 148, as shown in FIG. 11. The outer end of slot 142 is engaged by the bottom of notch 152 in the tongue. Thus, the flaps forming the bottom of the carton are held together horizontally and their outward or downward movement limited.

FIG. 10 shows the carton in its flattened condition prior to the carton being opened, preparatory to its being filled.

EMBODIMENT OF FIGS. 13 TO 18

Figure 13:
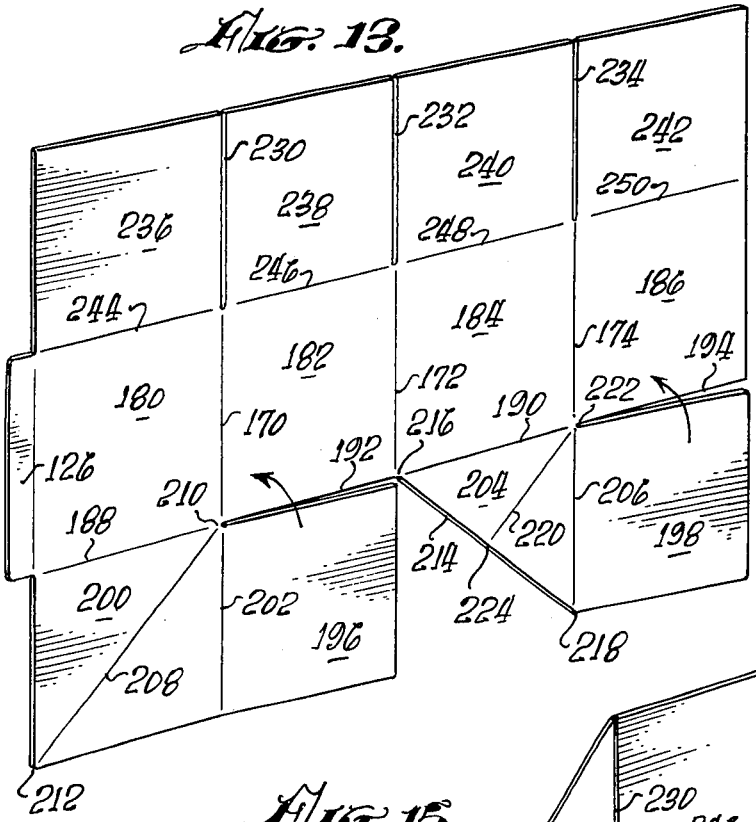
FIG. 13 is a perspective view of a blank showing the score lines and the cuts severing portions of flaps.
Figure 18:
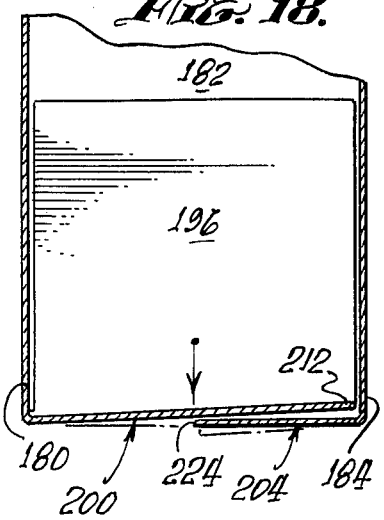
FIG. 18 is a sectional view taken on line 18—18 of FIG. 17.

Referring to FIGS. 13 through 18, there is shown another alternative arrangement wherein the carton is square in cross-section, although it is to be understood that it could be rectangular in cross-section. In FIG. 13 there is shown a blank of suitable material such as, for example, cardboard, heavy paper, corrugated paper or any other suitable material. The blank is scored along lines 170, 172 and 174. This scoring provides vertical fold lines for the formed carton body. These fold lines are parallel to each other and parallel to the side edges 176 and 178 of the blank, said fold lines define the side edges 176 and 178 vertical edges of body panels 180, 182, 184 and 186. There is scoring 188 and 190 at the bottom of the respective panels 180 and 184. Panels 182 and 186 are cut horizontally along their respective bottoms 192 and 194 to provide flaps 196 and 198. Flap 196 is connected to a flap 100 along a score or fold line 202, flap 200 being connected to panel 180 along fold line 188. Panel 198 is connected to flap 204 along fold line 206. Flap 204 is connected to panel 184 along score or fold line 190. Flap 200 is square and has a score or fold line 208 which extends from the lower end 210 of score line 170 diagonally to the outer free corner 212 of flap 200. Flap 204 is connected to panel 184 along score or fold line 190 and is triangular in shape with a free edge 214 extending from the lower end 216 of fold or score line 172 to the free end 218 of score line 206.

Flaps 200 and 204 are connected to the lower ends of panels 180 and 184 along respective score lines 188 and 190 and said flaps are the full width of respective panels 180 and 184 where they join said panels. Panel 204 has a score line 220 that extends from the lower end 222 of score line 174 to the free edge 214 at a point 224 midway between the ends of free edge 214.

Thus flap 200 is diagonally longer than flap 204 and said flap 200 is of the same dimensions as the cross-section of the carton when open. One side of the longer flap is connected to panel 180 while the side defined by score line 202 is connected to flap 196, termed anchoring flap, which is adhesively secured to the inner side of panel 182. The other or free edges of flap 200 lie along the fold of the shorter bottom flap 204 and the fold line 206 of the anchor flap 198 when the carton is fully formed and open. Thus, the larger flap 200 completely closes the bottom of the carton when fully formed and open and is fully supported about its periphery so that the contents of the carton is fully supported. Additional support for the larger flap 200 is provided by the smaller bottom flap 204 when the carton is fully formed and in its open position, the smaller bottom flap 204 being beneath a portion of the larger bottom flap 200.

The blank is cut along extensions of score or fold lines 170, 172 and 174 as shown at 230, 232 and 234 to provide top flaps 236, 238, 240 and 242 which fold inwardly along fold lines 244, 246, 248 and 250, said flaps 236, 238, 240 and 242 forming the top cover for the open carton.

Figure 14:
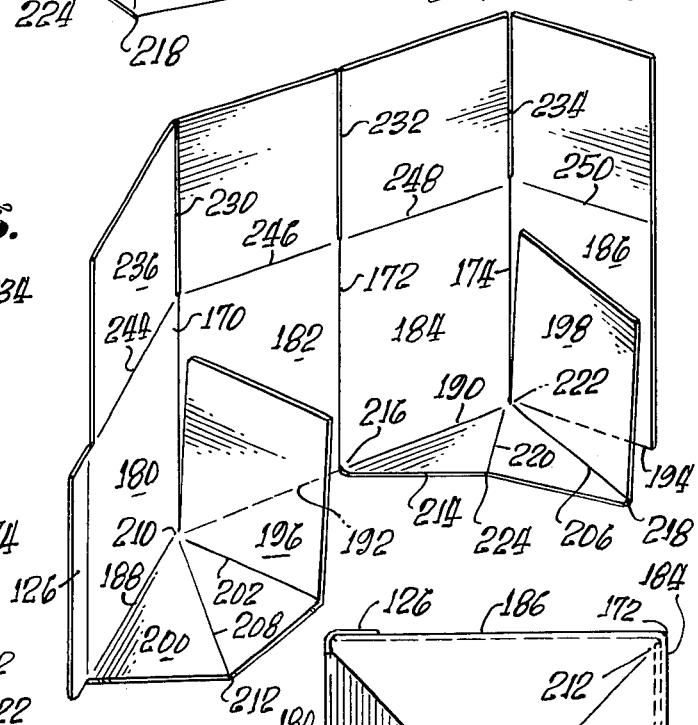
FIG. 14 is a perspective view of the blank partly folded.

FIG. 14 shows the initial folding or folming of the carton with the flaps 196 and 198 raised but not secured to the adjacent panels 182 and 186 while flaps 200 and 204 are partly folded along their fold lines 208 and 220 respectively.

Figure 15:
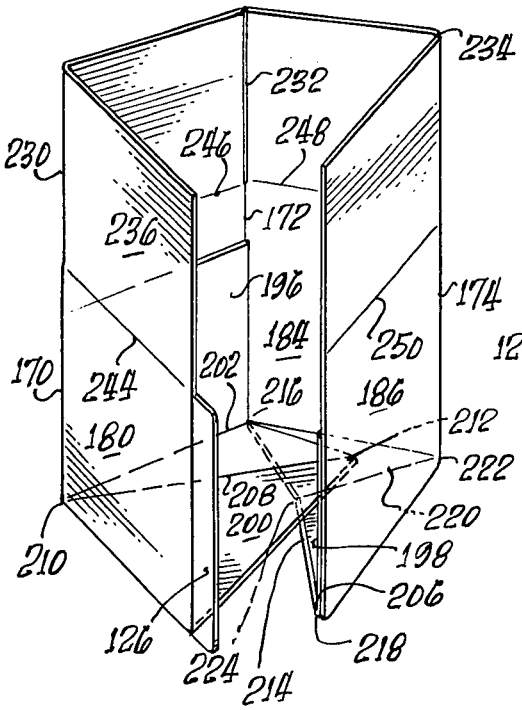
FIG. 15 is a perspective view showing the blank additionally folded.
Figure 17:
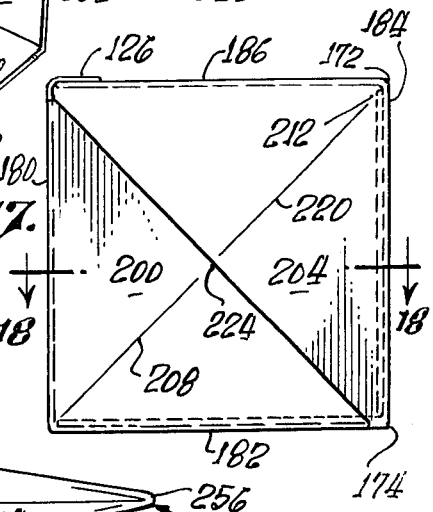
FIG. 17 is a bottom end view of the formed and open carton.

In FIG. 15, the carton is shown as additionally folded with flaps 196 and 198 adhesively secured to the inner surfaces of respective panels 182 and 186. Flaps 200 and 204 are brought into an overlying relationship, flap 200 being above flap 204.

Figure 16:
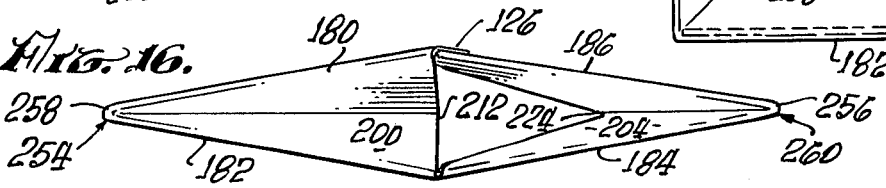
FIG. 16 is an end view of the formed and flattened carton.

The carton is shown in FIG. 16 in its substantially flattened condition. When thus flattened, pressure on the free edges 254 and 256, in the direction of the arrows 258 and 260, cause the carton to open up. Flaps 200 and 204 automatically move to the positions shown in FIGS. 17 and 18, thus closing the bottom of the carton. After the carton has been filled, flaps 236, 238, 240 and 242 are folded downwardly to form the top of the carton. These flaps, when in the closed position, may be taped or otherwise secured in the closed position.

The invention and its attendant advantages will be understood from the foregoing description, and it will be apparent that various changes may be made in the form, construction and arrangement of the parts of the invention without departing from the spirit or scope thereof or sacrificing its material advantages, the arrangement hereinbefore described being merely by way of example, and I do not wish to be restricted to the specific form shown or uses mentioned except as defined in the accompanying claims.

We claim:

1. A flattenable carton, comprising:

four sides;

means forming a bottom for said carton, said means comprising a flap connected to one end of one of the sides, said flap having a tongue at the outer free edge and a score line extending from a lower corner of the side from which the tongue extends and along which said tongue is adapted to be folded;

a second flap having one edge connected to the first flap, there being a score line separating said flap, the other edges of said second flap being free;

a third flap connected to the side opposite the side to which the first flap is connected, said third flap having a generally diagonally arranged slot, and a score line extending diagonally of the third flap and intersecting said slot;

a fourth flap having one edge connected to a third flap along a score line, the other edges of the fourth flap being free;

when the carton is folded and flattened, the second and fourth flaps are secured to the inner surfaces of the respective adjacent sides, and the first and third flaps are folded along their fold lines with the tongue of the first flap in alignment with the slot of the third flap; and pressure on the outer corners of the folded and flattened carton causing the tongue to enter the trough of the slotted flap and enter the slot to complete the bottom of the carton.

2. The invention defined by claim 1, wherein the folded first and third flaps define troughs, the tongue of the first flap being aligned with the trough of the third flap.

3. The invention defined by claim 1, wherein the third flap, having the slot, is diagonally longer than the first flap.

4. The invention defined by claim 1, wherein the length of that portion of the first flap having the tongue is longer from the fold line to the end of the tongue than the length of the third flap from the slot to the adjacent free edge of the third flap.

5. The invention defined by claim 4, wherein the carton is rectangular in cross-section.

6. The invention defined by claim 1, wherein the carton is square in cross-section.

7. The invention defined by claim 1, including shoulders at each side of the tongue against which one edge of the slot engage said shoulders, limiting interlocking movement of the flaps and restraining outward bulging of said flaps.

8. The invention defined by claim 1, including means for holding the flaps forming the bottom against outward displacement.

9. A carton blank, comprising:

a sheet of foldable material scored longitudinally relative to the formed carton to define four panels;

flaps for two of the panels, there being a panel between the panels having the flaps, said panels having the flaps being scored at the bottom with the flaps connected to respective panels along said scoring;

one of the flaps extending from one end panel having the outer corner removed, leaving a diagonal free edge, said flap being scored normally to said free edge from said free edge to the corner opposite thereof;

the other flap being full sized and having the same peripheral dimensions and shape as the cross-section of the formed, open carton and being scored diagonally from its inner corner to its opposite, free corner, the full sized flap being longer diagonally than the one flap;

means for securing the inner edge of the full size flap to the panel next to the panel from which said flap extends; and means for securing the outer edge of the shorter flap to the remaining panel.

10. The invention defined by claim 9, wherein the means for securing said flaps to their respective panels comprises flaps attached to the respective full size flap and short flap.

11. The invention defined by claim 10, wherein the flaps for securing the full sized flap and the short flap to the panels are adhesively secured to said panels.

12. The invention defined by claim 1, wherein the other ends, of at least some of the panels, have cover flaps adapted to be folded to form a top cover for the carton.

13. The invention defined by claim 9, including flaps attached to top ends, of at least some of the panels, said flaps being adapted to be folded for closing the top of the carton.

* * * * *